US005082045A

United States Patent [19]

Lambert

[11] Patent Number: 5,082,045

[45] Date of Patent: Jan. 21, 1992

[54] CASTING APPARATUS AND METHOD

[75] Inventor: Derek Lambert, Rhu, United Kingdom

[73] Assignee: Fry's Metals Ltd., London, United Kingdom

[21] Appl. No.: 711,130

[22] Filed: Jun. 4, 1991

Related U.S. Application Data

[63] Continuation of Ser. No. 472,962, Jan. 31, 1990, abandoned.

[30] Foreign Application Priority Data

Feb. 1, 1989 [GB] United Kingdom ..... 8902120

[51] Int. Cl.[5] ..... B22D 17/04

[52] U.S. Cl. ..... 164/113; 164/133; 164/316

[58] Field of Search ..... 164/113, 133, 309, 310, 164/316, 337; 222/334, 380

[56] References Cited

U.S. PATENT DOCUMENTS

| | | | |
|---|---|---|---|
| 3,168,225 | 2/1965 | Miller et al. | 222/380 |
| 3,184,811 | 5/1965 | Bennett et al. . | |
| 3,430,685 | 3/1969 | Drugowitsch . | |
| 3,581,767 | 6/1971 | Jackson . | |

FOREIGN PATENT DOCUMENTS

| | | | |
|---|---|---|---|
| 61-259864 | 11/1986 | Japan | 164/337 |
| 260637 | 11/1970 | U.S.S.R. | 164/316 |
| 2063127 | 6/1981 | United Kingdom . | |

*Primary Examiner*—Kuang Y. Lin

*Attorney, Agent, or Firm*—Watson, Cole, Grindle & Watson

[57] ABSTRACT

Casting apparatus which includes a dispenser (4,5) defining a dispensing chamber (21) of variable volume receiving molten metal (3) in use, a valve (8) having a housing (23) defining a valve chamber (24) and a passageway (7) communicating between the valve chamber and the dispensing chamber, the valve further defining an inlet port (8*a*) communicating with a supply (2) of molten metal and further defining an outlet port (8*c*) communicating with a die (9), a valve member (8*d*) located in the valve chamber, actuating mechanism (26) selectively operable to move the valve member into a first position closing the inlet port and a second position closing the outlet port whereby in the first position the valve connects the dispensing chamber with the die for casting metal and in the second position the valve connects the dispensing chamber with the supply of molten metal for recharging the dispensing chamber, the valve including first and second annular seats (41,42) surrounding the inlet and outlet ports respectively and engageable by respective first and second annular sealing surfaces (47,48) of the valve member in the first and second positions respectively and wherein the actuating mechanism includes a stem (25) fixed to the valve member, a linear actuator (27) operable to provide reciprocating axial movement of the stem, and a rotating mechanism (15) operable during axial movement of the stem to rotate the stem so as to vary the relative contact position of the respective seat and sealing surfaces.

8 Claims, 4 Drawing Sheets

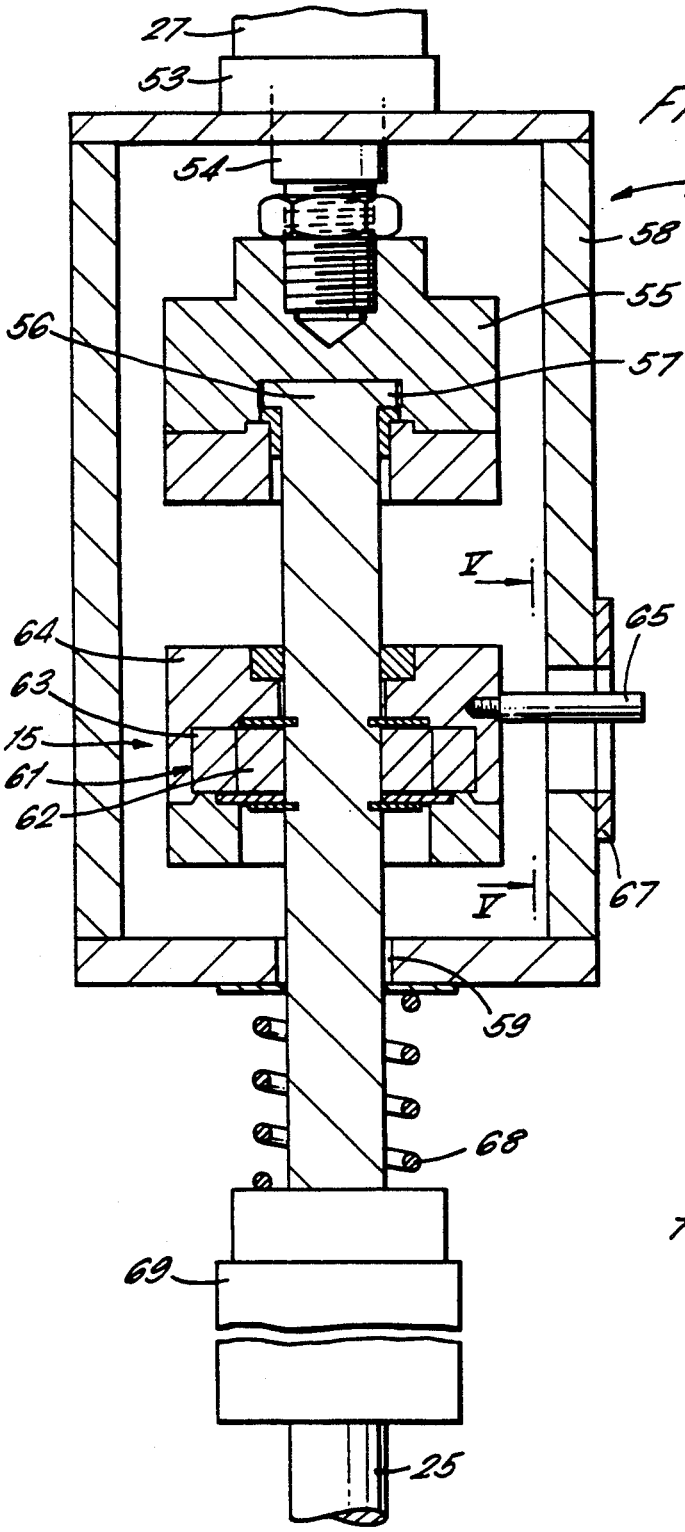
FIG. 4.
FIG. 5.
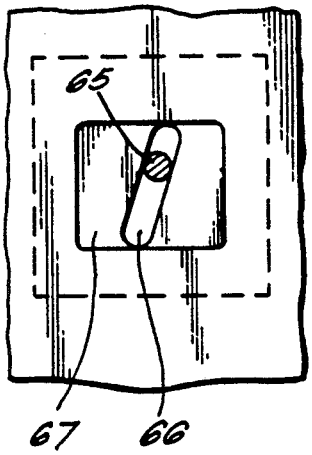
FIG. 6.
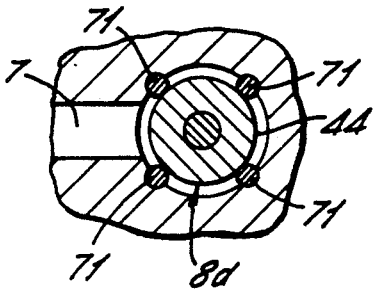

CASTING APPARATUS AND METHOD

This application is a continuation of application Ser. No. 472,962, filed Jan. 31, 1990, now abandoned.

BACKGROUND OF THE INVENTION

This invention relates to casting apparatus and to a method of casting for use in casting metals, and in particular but not exclusively for use in casting low melting point alloys into a die. The casting of such alloys is used for example to produce cores which may be subsequently used in moulding plastic material in which the alloy is subsequently removed from the moulded plastic component by melting the core.

It is proposed in GB-2063127 to provide casting apparatus in which a die is supplied with molten alloy under pressure from a cylinder and piston arrangement via a three-way valve which, on the return stroke of the piston, is actuated to connect the cylinder with a supply of molten metal for recharging the cylinder. A disadvantage of such a valve is that its operation relies on a valve member movable within a valve chamber and guided by sliding contact between the member and the chamber walls, leading to the problems of wear, misalignment and possible jamming of the valve.

According to the present invention there is disclosed casting apparatus comprising a dispenser defining a dispensing chamber of variable volume receiving molten metal in use, a valve having a housing defining a valve chamber and a passageway communicating between the valve chamber and the dispensing chamber, the valve further defining an inlet port communicating with a supply of molten metal and further defining an outlet port communicating with a die, a valve member located in the valve chamber, actuating means selectively operable to move the valve member into a first position closing the inlet port and a second position closing the outlet port whereby in the first position the valve connects the dispensing chamber with the die for casting metal and in the second position the valve connects the dispensing chamber with the supply of molten metal for recharging the dispensing chamber, the valve including first and second annular seats surrounding the inlet and outlet ports respectively and engageable by respective first and second annular sealing surfaces of the valve member in the first and second positions respectively and wherein the actuating means comprises a stem fixed to the valve member, a linear actuator operable to provide reciprocating axial movement of the stem and rotating means operable during axial movement of the stem to rotate the stem so as to vary the relative contact position of the respective seat and sealing surfaces.

An advantage of such an arrangement is that the angular position of the valve member relative to the valve housing can be indexed through angular increments (other than multiples of 360°) such that repeated seating contact between the same points is avoided. Both the sealing surfaces and the respective seats will then tend to wear evenly, such that leak-free sealing is maintained. The indexing also tends to prevent the build-up of solid material on the sealing faces and seats.

Conveniently, the rotating means comprises a collar rotatably mounted on the stem, means rotating the collar in a first direction during axial movement of the stem in a first direction and in a reverse direction of rotation during axial movement of the stem in a reverse direction and ratchet means operable between the collar and the stem to transmit rotational movement to the stem in one direction only.

Preferably each of the sealing surfaces is profiled so as to make substantially line contact with the respective seat.

An advantage of such line contact is that a substantially leak-free seal is provided and the build-up of deposits on the respective sealing surfaces is prevented.

Advantageously the profile of each of the first and second sealing surfaces is substantially that of a segment of a sphere.

An advantage of this profile is that it facilitates self-alignment of the valve member on making sealing contact and enables line contact to be made between the sealing surfaces and the respective seats.

Preferably the valve chamber is bounded by chamber walls which are spaced from the valve member by circumferentially spaced guide means projecting from the chamber walls into sliding contact with the valve member to maintain the valve member in axial alignment during travel of the valve member between the first and second positions.

Preferably the valve housing is oriented in use such that the inlet port is vertically above the outlet port and the apparatus includes means biassing the valve member downwardly into the second position such that the outlet port is automatically closed if the valve actuating means fails to operate.

An advantage of such an arrangement is that outflow of molten metal from the outlet port of the valve is prevented under conditions of failure of the valve actuating means. This is particularly important when it is necessary to disconnect the die from the apparatus in which case failure of the valve actuating means might otherwise result in spillage of molten metal.

Advantageously the valve includes a further port communicating with a pressure relief valve operable to limit pressure of metal in the valve to a predetermined limit.

This is particularly advantageous where the dispenser includes for example a hydraulic actuator capable of generating excessive pressures under certain conditions. The pressure relief valve enables the pressure of molten metal supplied to the die to be kept below a predetermined limit.

The casting apparatus may include a dispenser which comprises one or more cylinders having a cooperating piston and means actuating the piston to vary the volume of the dispensing chamber constituted by the cylinders.

According to a further aspect of the present invention there is disclosed a method of casting by means of apparatus comprising a dispenser defining a dispensing chamber of variable volume receiving molten metal in use, a valve having a housing defining a valve chamber and a passageway communicating between the valve chamber and the dispensing chamber, the valve further defining an inlet port communicating with a supply of molten metal and further defining an outlet port communicating with a die, a valve member located in the valve chamber, actuating means selectively operable to move the valve member into a first position closing the inlet port and a second position closing the outlet port whereby in the first position the valve connects the dispensing chamber with the die for casting metal and in the second position the valve connects the dispensing chamber with the supply of molten metal for recharging the dispensing chamber, the valve including first and second annular seats surrounding the inlet and outlet ports respectively and engageable by respective first and second annular sealing surfaces of the valve member in the first and second positions respectively and wherein the actuating means comprises a stem fixed to the valve member, a linear actuator operable to provide reciprocating axial movement of the stem and rotating means operable to rotate the stem, the method including the step of rotating the valve member relative to the valve housing during axial movement of the valve member in at least one direction of axial movement so as to vary the relative contact position of the respective seat and sealing surfaces.

Embodiments of the present invention will now be described by way of example only and with reference to the accompanying drawings.

BRIEF DESCRIPTION OF THE DRAWINGS

FIG. 4 is a sectioned elevation of a further part of the apparatus of FIG. 3 showing detail of valve-actuating means including a ratchet;

FIG. 5 is a view of the apparatus of FIGS. 3 and 4 taken at V—V in FIG. 4 showing means for rotating the valve actuating stem; and FIG. 6 is a sectioned plan view showing detail of the valve.

DETAILED DESCRIPTION OF THE PREFERRED EMBODIMENTS

Figure 1:
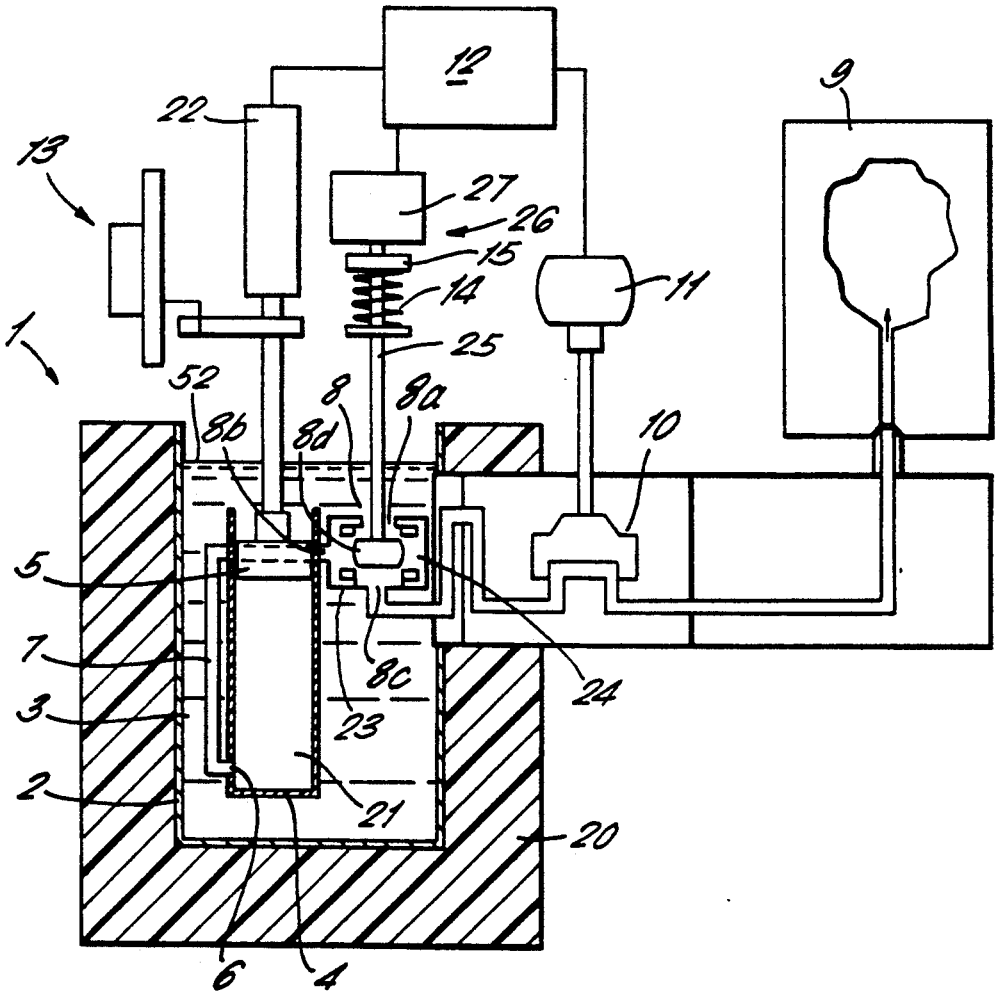
FIG. 1 is a schematic sectioned elevation of casting apparatus in accordance with the present invention.

The casting apparatus 1 of FIG. 1 is suitable for casting low temperature alloys having a solidus temperature in the range of 35°-300° C. Apparatus 1 has a heated tank 2 which holds a quantity of molten alloy 3 to a level 52 and is insulated by a layer of insulation 20. Within the tank 2 and immersed in the molten alloy 3 is a piston 5 and cylinder 4 defining a dispensing chamber 21 of variable volume. The cylinder 4 has a vertical axis within the tank 2 and the piston 5 is reciprocatingly drivable by a pneumatic actuator 22. The cylinder 4 has an opening 6 which is in communication with a 3-port ball valve 8 via a conduit or passageway 7. The opening 6 allows alloy 3 to enter and leave the dispensing chamber 21 of the cylinder 4 when the chamber volume is varied by movement of the piston 5 and is situated so that it is below the piston 5 at all times during operation.

The 3-port ball valve 8 is also situated within the tank 2, immersed in the molten alloy 3. The 3-port ball valve 8 has uppermost an inlet port **8*a* which is open to the supply of molten alloy 3 within the tank 2, a side port 8*b* which is connected to the conduit 7 and so is in communication with the chamber 21 of the cylinder 4, and lowermost an outlet port 8*c* which is in communication with a die 9 via a flow valve 10 which is operated by a rotary actuator 11**.

The 3-port ball valve 8 has a housing 23 defining a valve chamber 24 in communication with the inlet port **8*a*, the side port 8*b* and the outlet port 8*c*. A ball-like valve member 8*d* is located in the valve chamber 24 and is supported on a vertical valve stem 25 which extends into the chamber 24 through the inlet port 8*a*. The valve 8 is provided with actuating means 26 operable to raise and lower the valve member 8*d*. In its fully raised position the valve member 8*d* closes the inlet port 8*a* and in its fully lowered position the valve member closes the outlet port 8*c*. In FIG. 1 the valve member 8*d* is shown intermediate its raised and lowered positions. In use the valve member 8*d*** would normally be either fully raised or fully lowered.

The actuating means 26 has a pneumatic actuator 27 arranged to linearly drive the valve stem 25 through an indexing mechanism 15 which rotates the valve stem 25 and with it the valve member **8*d* through 5° during each upstroke of the valve stem. The indexing mechanism 15 includes a ratchet (not shown in FIG. 1) which communicates rotation to the valve stem 25 during each upstroke of the valve stem 25** but communicates no such rotation during each downstroke.

The actuating means 26 also has a safety spring 14 which biasses the stem 25 downwards to automatically close the outlet port **8*c* of the 3-port ball valve 8 in the event that the pneumatic actuator 27 fails. Thus, in such a failure situation, no molten alloy would be able to flow to or from the die 9 via the valve 8. The rotation of the valve member 8*d* provided by the indexing mechanism 15** prevents the valve member from becoming deformed through continuous wear at one point and instead ensures even wear.

The casting apparatus 1 also has a control system 12 which controls the operation of the pneumatic actuator 22 of the piston 5, the actuating means 26 of the 3-port ball valve 8 and the rotary actuator 11 of the flow valve 10. The piston 5 also has a sensor 13 which detects the position of the piston 5 within the cylinder 4 and feeds the information back to the control system 12.

Initially the piston 5 is in its up position and the cylinder 4 is filled with molten alloy 3. In operation the control system 12 actuates the pneumatic actuator 22 so that the piston 5 begins to move down. The speed of the piston 5 is controlled by the control system 12 which is able to detect the position of the piston at any given time by the sensor 13.

As the piston 5 starts to move down, the control system 12 actuates the actuating means 26 of the 3-port ball valve 8 such that the valve member **8*d* is moved into its raised position, closing the inlet port 8*a*. The side port 8*b* and outlet port 8*c* of the 3-port ball valve 8 are open and in communication with one another. The control system 12 also opens the flow valve 10 by operating the rotary actuator 11. The piston 5 moves down and molten alloy is forced from the dispensing chamber 21 of the cylinder 4 along the conduit 7 and into the 3-port ball valve 8. The molten alloy then flows through the 3-port ball valve 8 and out of the outlet port 8*c* to the die 9 via the flow valve 10. After a predetermined time cycle in which the die 9 has been filled with the molten alloy, the control system 12 closes the flow valve 10 by operating the rotary actuator 11. At the same time, the control system 12 closes the outlet port 8*c* and opens the inlet port 8*a* so that the molten alloy 3 in the tank 2 is put in communication with the cylinder 4. The piston 5 is then raised so that the dispensing chamber 21 of the cylinder 4 is recharged with molten alloy drawn from the tank 2**.

It is necessary for pressure to be applied to the molten alloy in the die 9 even when the die 9 has been filled, for a short period of time during which the casting cools. This is to ensure that the castings do not become hollow through the contraction of the alloy as it solidifies. The application of this pressure can be pre-set through the control system 12 so that the piston 5 maintains the pressure on the molten alloy in the die 9 once the die 9 is filled.

A further feature of the casting apparatus 1 is that the control system 12 can be programmed so that at pre-set periods of time the outlet port 8*c* of the 3-port ball valve 8 is closed so that the dispensing chamber 4 is put in communication with the molten alloy 3 in the tank 2. By reciprocating operation of the piston 5, the cylinder 4 is then repeatedly emptied and filled with molten alloy from the tank 2. Hence the molten alloy is circulated and stirred by this action so as to prevent separation of the molten alloy.

Figure 2:
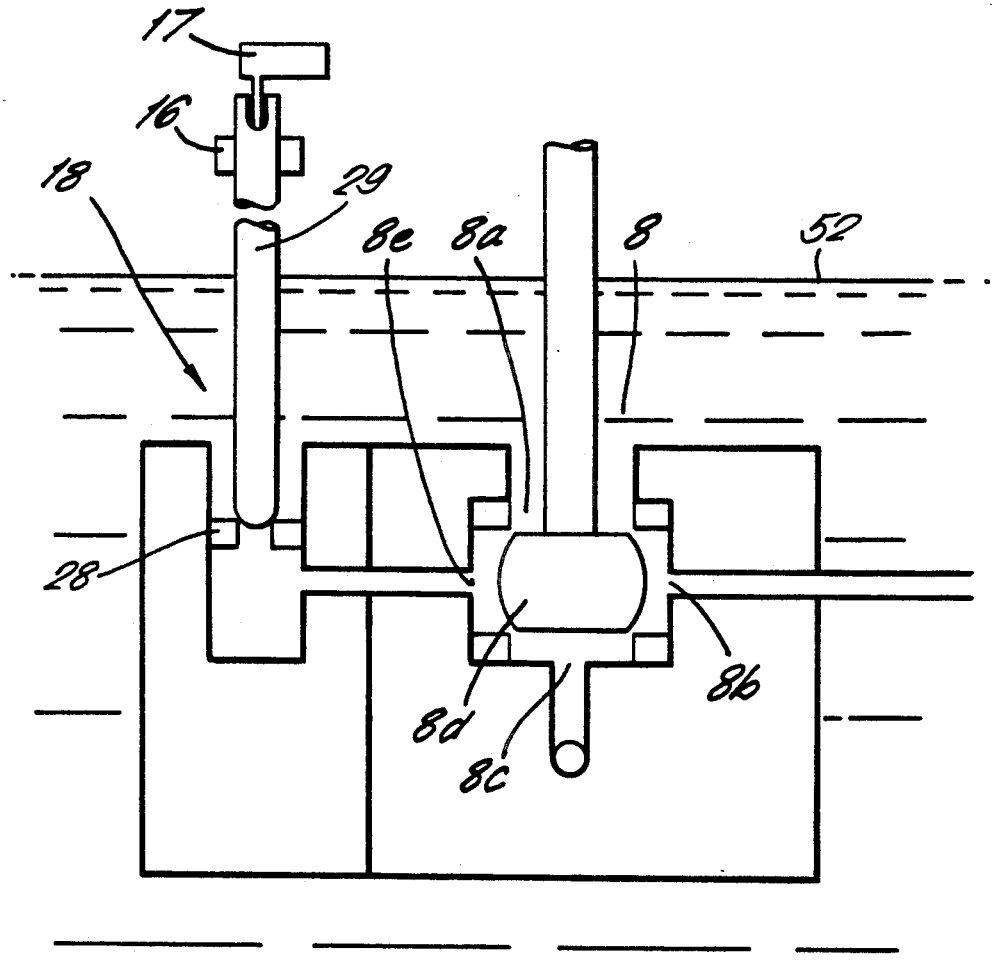
FIG. 2 is a schematic sectioned elevation of part of an alternative apparatus having a modified valve and a pressure relief valve.

The casting apparatus 1 may be modified to have a pressure relief valve 18 as shown in FIG. 2. The apparatus of FIG. 2 will be described using corresponding reference numerals to those of FIG. 1 where appropriate for corresponding elements. The inclusion of the pressure relief valve 18 allows the casting apparatus 1 to incorporate a hydraulically actuated piston 5 with a servo proportioning system. The relatively high pressures available from a hydraulic actuator necessitate the use of a pressure relief valve 18 to prevent the maximum available pressure being exerted on the die 19. Without such a relief valve 18, the wall thickness of the die 9 would have to be increased, which would increase the thermal capacity of the die, resulting in an increase in the cycle time for each casting operation.

The pressure relief valve 18 consists of an upwardly directed nozzle 28 immersed in the tank 2 and normally closed by a downwardly extending rod 29 which carries a weight !6 acting to bias the rod into a sealing engagement with the nozzle. Excess pressure within the valve 8 is communicated through the further port 8*e* to the nozzle 28 resulting in the rod 29 being lifted so as to discharge molten alloy 3 from the nozzle into the tank 2. A microswitch 17 is provided to sense movement of the rod 29 and its signal is input to the control system 12. This also allows the control system 12 to respond to signals received from the microswitch 17 as an indication that the die 9 is filled. The control system 12 will then respond by changing the speed of the piston 5 in the cylinder 4 to a very slow creep speed so that sufficient pressure is maintained to ensure no holes are formed in the alloy within the die due to the contraction of the alloy as it cools.

Although the piston 5 and the 3-port ball valve 8 are described as being operated either hydraulically or pneumatically any other usual method of operating the piston 5 and the valve 8 may be used.

Figure 3:
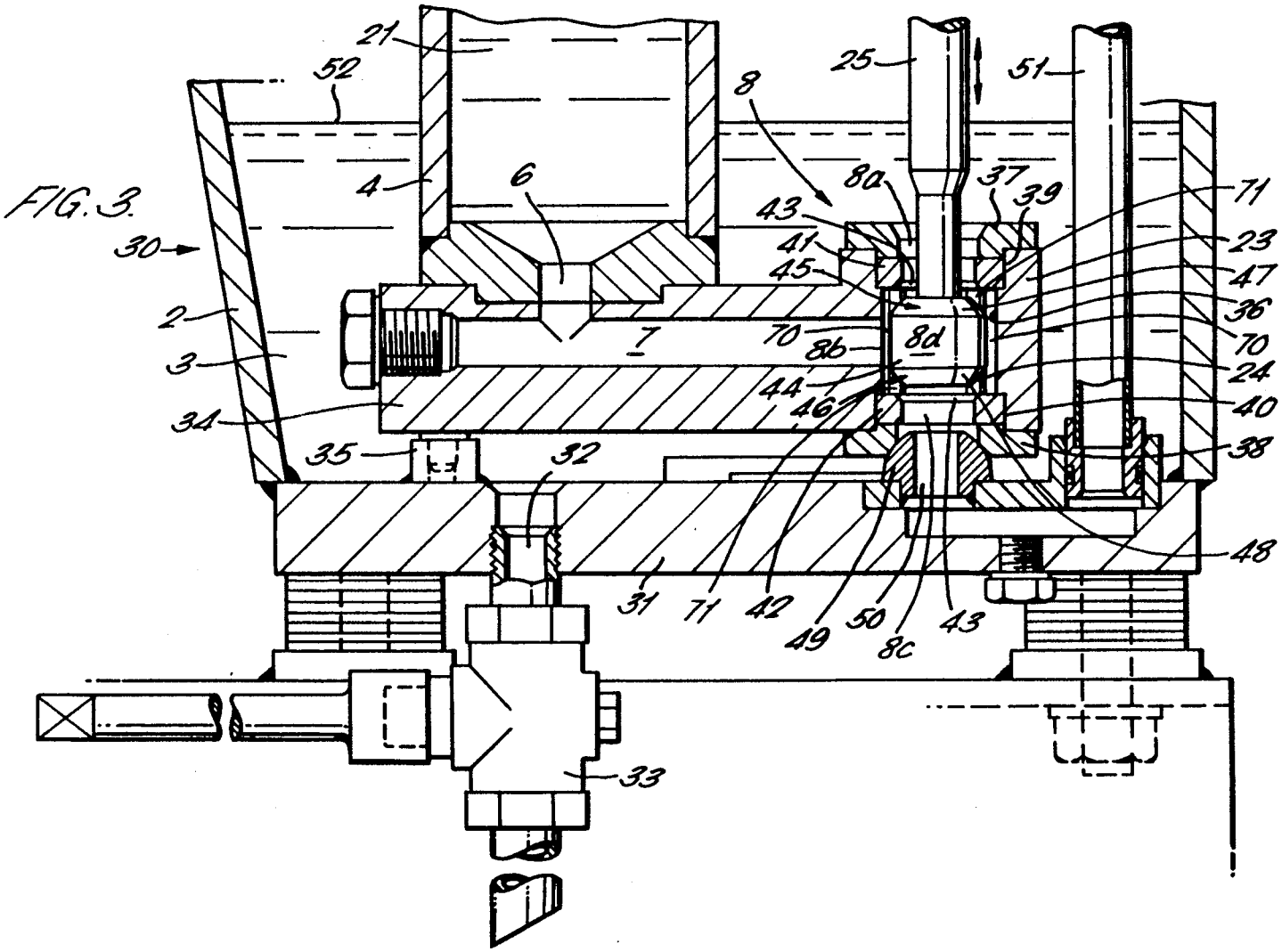
FIG. 3 is a sectioned elevation of part of a further alternative casting apparatus showing detail of the valve and its connection to a dispensing cylinder.

Further modified apparatus 30 is shown in FIGS. 3, 4 and 5 and will now be described using corresponding reference numerals to those of FIGS. 1 and 2 where appropriate for corresponding elements. Referring to FIG. 3, apparatus 30 comprises a tank 2 containing a quantity of molten alloy 3 and having a flat bottom portion 31 in which is provided a drain port 32 connected to a drain valve 33.

A vertically-extending cylinder 4 is mounted in the tank 2 on a base assembly 34 which is removably mounted on the bottom portion 31 by means of fittings 35 which allow the base assembly 34 to be accurately relocated relative to the bottom portion of the tank.

The cylinder 4 receives a piston (not shown) such that a dispensing chamber 21 defined within the cylinder has a volume which is variable by movement of the piston under the control of a control system 12 (not shown). The cylinder 4 has an opening 6 extending downwardly into communication with a horizontally-extending passageway 7. The base assembly 34 incorporates a housing 23 of a 3-port ball valve 8 and the passageway 7 communicates with a valve chamber 24 defined by the housing. The valve chamber 24 is of cylindrical shape having a vertical axis and the passageway 7 communicates with the chamber 24 via a side port 8*b* extending radially from the cylindrical wall 36 of the valve chamber.

The housing 23 has an upper end closure plate 37 defining an inlet port 8*a* and a lower end closure plate 38 defining an outlet port 8*c*. The chamber wall 36 includes annular recesses 39 and 40 adjacent the upper and lower end closure plates 37 and 38 respectively and within which an inlet valve seat 41 and an outlet valve seat 42 are respectively retained. Each of the valve seats 41 and 42 is annular in shape with a generally square cross-section but with a chamfered edge portion 43 exposed to the interior of the valve chamber 24 such that the respective ports 8*a*, 8*c* are tapered.

The valve seats 41 and 42 are formed of steel coated in tungsten carbide so as to be resistant to metallurgical attack.

A valve member 8*d* is located within the valve chamber 24 and is formed of tool steel. The valve member 8*d* has a cylindrical centre portion 44 coaxially aligned with the cylindrical walls 36 of the valve chamber 24 and has upper and lower end portions 45 and 46. respectively, which taper from a diameter greater than the internal diameter of the valve seats 41 and 42 to a diameter which is less than the internal diameter of the valve seats. The upper and lower end portions 45 and 46 define sealing surfaces 47 and 48, respectively, which are profiled so as to be part spherical.

As shown in FIG. 6 the valve member 8*d* is maintained in axial alignment within the valve chamber 24 by means of four circumferentially spaced steel rods 71 which extend vertically so as to provide means for guiding the valve member during its travel between raised and lowered positions.

The valve member 8*d* is rigidly connected to a valve stem 25 which extends coaxially with the chamber 24 through the inlet port 8*a* and projects upwardly to an extent which is above the level 52 of alloy 3.

The lower end closure plate 38 is chamfered to make sealing engagement with a domed projection 49 attached to the bottom portion 31 of the tank 2 and defining a duct 50 in communication with a pipe 51 connected to a flow valve 10 (not shown).

The pipe 51 extends vertically from the bottom portion 31 to a level above that of the level 52 of alloy 3.

Referring to FIGS. 4 and 5, the valve stem 25 is axially movable by actuating means 26 in which a pneumatic actuator 27 has a fixed body 53 and a reciprocatable shaft 54 to which is connected a boss 55. The valve stem 25 has an upper end portion 56 which is journalled in the boss 55 to permit relative rotational movement and is keyed to the boss by means of a radially-extending flange 57 to prevent relative axial movement between the valve stem and the shaft.

The boss 55 is enclosed in a casing 58 fixed to the body 53 from which the valve stem 25 projects downwardly through an aperture 59. An indexing mechanism 15 is incorporated in the casing 58 and comprises a ratchet 61 having an inner ring 62 fixedly mounted on the valve stem 25 and an outer ring 63 circumferentially mounted on the inner ring and rotatable relative to the inner ring only in an anti-clockwise direction of rotation as viewed from above.

A collar 64 is rotatably mounted on the valve stem 25 and fixedly connected to the outer ring 63. A pin 65 projects radially from the collar 64 and is received in a guide slot 66 formed in a metal plate 67 mounted on the casing 58. The plate 67 is located in a vertical plane and as seen in FIG. 5 the guide slot extends diagonally upwards from left to right as viewed horizontally such that vertical movement of the lever 65 is accompanied by horizontal movement defined by the inclination of the slot.

A coil spring 68 is mounted on the valve stem 25 between the casing 58 and a coupling 69 connected to the valve stem, the spring 68 being held in compression so that a continuous downward bias is applied to the valve member 8*d* via the valve stem.

In use the valve member 8*d* is normally maintained in a fully lowered position prior to dispensing of alloy 3 to the die 9 and in its fully lowered position (not shown) the lower end portion 46 of the valve member 8*d* makes contact with the outlet valve seat 42 such that a circular line contact is made between the sealing surface 48 and the chamfered edge portion 43 of the lower end portion. In this condition of the valve 8 the outlet port 8*c* is closed and the inlet port 8*a* is opened such that molten alloy 3 can flow to or from the dispensing chamber 21 via the passageway 7, the valve chamber 24 and the inlet port 8*a*. The piston 5 may be periodically raised and lowered to draw alloy 3 into and out of the dispensing chamber 21 to provide agitation and mixing of the alloy prior to dispensing.

When alloy 3 is to be dispensed to the die 9 the dispensing chamber 21 is charged with alloy and the actuating means 26 is actuated under the control of the control system 12 to raise the valve stem 25. The valve member 8*d* moves upwardly with the valve stem 25 and is shown in FIG. 3 in an intermediate position midway between its raised and lowered positions. During this travel the valve member 8*d* is guided coaxially within the chamber walls 36 by the rods 71. The valve chamber walls 36 are spaced from the valve member 8*d* by a space 70 which provides sufficient clearance to allow the free flow of alloy. At its upper limit of travel the valve member 8*d* is located in coaxial alignment with the inlet valve seat 41 by virtue of the spherical profile of the sealing surface 47 defined by the upper end portion 45.

Accurate location is assisted by the conically tapered chamfered edge portion 43. A continuous circular line contact is formed between the sealing surface 47 and the inlet valve seat 41 so as to close the inlet port 8*a*.

The flow valve 10 is then opened such that a flow path is established between the dispensing chamber 21 and the die 9 and the pneumatic actuator 22 is activated under the control of the control system 12 to provide downward movement of the piston 5. Alloy 3 is displaced from the dispensing chamber 21 and flows through the passageway 7, through the valve 8, through the pipe 51 and into the die 9 via the flow valve 10. When the die 9 is full, pressure may continue to be applied by the actuator 22 during cooling of the alloy within the die. The valve 10 is then closed and the actuator 22 deactivated.

In order to recharge the dispensing chamber 21 the pneumatic actuator 27 is activated under the control of the control system 12 to lower the valve member 8*d* so as to close the outlet port 8*c*. Engagement of the valve member 8*d* is such that a continuous circular line contact is established between the sealing surface 48 and the outlet valve seat 42. The dispensing chamber 21 may then be recharged by raising the piston 5 to increase the chamber volume.

During each upward stroke of the valve stem 25 the valve stem is rotated by 5° in a counter-clockwise direction as viewed from above in order to correspondingly rotate the valve member 8*d*. During each downstroke of the valve stem 25 no rotation of the stem or valve member 8*d* occurs, so that during successive actuations of the valve 8 the position of the sealing surfaces 47 and 48 relative to the seats 41 and 42 is indexed in steps of 5° rotation about the stem axis. In this way any wear of the valve member is evened out and continued continuous line contact sealing is ensured between the valve member and the seats.

The indexing mechanism 15 relies upon the horizontal movement imparted to the pin 65 by the guide slot 66 during vertical displacement of the collar 64 to which the pin is fixed. This horizontal movement of the pin 65 results in rotational movement of the collar in a clockwise direction as viewed from above during the downstroke of the valve stem and in an anti-clockwise direction during the upstroke. The ratchet 61 transmits to the shaft only the anti-clockwise motion so that the net effect of a sequence of valve actuations is that the valve stem is progressively rotated or indexed in steps of 5°.

The dispenser, valve and base assembly 34 can be lifted out of the tank 2 for cleaning and servicing and the valve seats 41, 42 are readily replaceable by removal of the upper and lower end closure plates 37 and 38 respectively. On refitting the base assembly within the tank, the domed projection 49 makes sealing contact with the lower end closure plate 38 thereby connecting the outlet port 8*c* in communication with the pipe 51.

Alternative arrangements in accordance with the present invention are possible and include for example the addition of a further port 8*e* in the valve of FIG. 3 communicating with a pressure relief valve of the type shown schematically in FIG. 2. The dispenser of the preferred embodiments may include a linear actuator other than pneumatic if required. The tank containing molten metal may accommodate more than one dispensing cylinder and more than one cylinder may be connected to a single valve for dispensing to a die. Alternatively more than one cylinder may be provided in the same tank with separate valves for dispensing metal into respective separate cavities within a complex die or into separate dies.

The rotating means for rotating the valve stem may be modified to include a mechanism providing rotation on the downstroke of the valve member instead of or in addition to rotation in the same sense provided during the upstroke.

The spring 14 provided for the purpose of biassing downwardly the valve member may be replaced by a suitable weight. The density of molten alloy in the tank will generally be greater than the density of material forming the valve stem and valve member so that the valve member will tend to float. The strength of downward bias will therefore depend upon these densities and the extent to which the valve stem projects above and below the surface 52.

The valve member may alternatively be formed in tungsten carbide coated steel.

What is claimed is:

1. Casting apparatus comprising a dispenser defining a dispensing chamber of variable volume receiving molten metal in use, a valve having a housing defining a valve chamber and a passageway communicating between the valve chamber and the dispensing chamber, the valve further defining an inlet port communicating with a supply of molten metal and further defining an outlet port communicating with a die, a valve member located in the valve chamber, actuating means selectively operable to move the valve member into a first position closing the inlet port and a second position closing the outlet port whereby in the first position the valve connects the dispensing chamber with the die for casting metal and in the second position the valve connects the dispensing chamber with the supply of molten metal for recharging the dispensing chamber, the valve including first and second profiled annular seats surrounding the inlet and outlet ports respectively and engageable by respective first and second profiled annular sealing surfaces of the valve member in the first and second positions respectively, the profiles of said first and second annular seats and said first and second annular sealing surfaces enabling substantial line contact to occur between said seats and said sealing surfaces, and wherein the actuating means comprises a stem fixed to the valve member, a linear actuator operable to provide reciprocating axial movement of the stem, the valve member being of greater diameter than the respective seats such that contact between the first and second sealing surfaces and the respective seats defines axial limits of travel of the stem and rotating means operable during axial movement of the stem to rotate the stem so as to vary the relative contact position of each seat and the respective sealing surface, said rotating means comprising means deriving rotational movement of the stem directly from linear movement of the stem whereby the rotating means is inoperable during seating contact between the sealing surfaces and the respective seats wherein the rotating means comprises a collar rotatably mounted on the stem, means rotating the collar in a first direction during axial movement of the stem in a first direction and in a reverse direction of rotation during axial movement of the stem in a reverse direction and ratchet means operable between the collar and the stem to transmit rotational movement to the stem in one direction only.

2. Casting apparatus as claimed in claim 1 wherein the profile of each of the first and second sealing surfaces is substantially that of a segment of a sphere.

3. Casting apparatus as claimed in claim 1 wherein the valve chamber is bounded by chamber walls which are spaced from the valve, member by circumferentially spaced guide means projecting from the chamber walls into sliding contact with the valve member to maintain the valve member in axial alignment during travel of the valve member between the first and second positions.

4. Casting apparatus as claimed in claim 1 wherein the valve housing is oriented in use such that the inlet port is vertically above the outlet port with the stem extending through the inlet port.

5. Casting apparatus as claimed in claim 4 wherein the apparatus includes means biassing the valve member downwardly into the second position such that the outlet port is automatically closed if the valve actuating means fails to operate.

6. Casting apparatus as claimed in claim 1 wherein the valve includes a further port communicating with a pressure relief valve operable to limit pressure of metal in the valve to a predetermined limit.

7. Casting apparatus as claimed in claim 1 wherein the dispenser comprises one or more cylinders having a cooperating piston and means actuating the piston to vary the volume of the dispensing chamber constituted by the cylinders.

8. A method of casting by means of casting apparatus comprising a dispenser defining a dispensing chamber of variable volume receiving molten metal in use, a valve having a housing defining a valve chamber and a passageway communicating between the valve chamber and the dispensing chamber, the valve further defining an inlet port communicating with a supply of molten metal and further defining an outlet port communicating with a die, a valve member located in the valve chamber, actuating means selectively operable to move the valve member into a first position closing the inlet port and a second position closing the outlet port whereby in the first position the valve connects the dispensing chamber with the die for casting metal and in the second position the valve connects the dispensing chamber with the supply of molten metal for recharging the dispensing chamber, the valve including first and second annular seats surrounding the inlet and outlet ports respectively and engageable by respective first and second annular sealing surfaces of the valve member in the first and second positions respectively and wherein the actuating means comprises a stem fixed to the valve member, a linear actuator operable to provide reciprocating axial movement of the stem and rotating means operable to rotate the stem wherein the rotating means comprises a collar rotatably mounted on the stem, means rotating the collar in a first direction during axial movement of the stem in a first direction and in reverse direction of rotation during axial movement of the stem in a reverse direction and ratchet means operable between the collar and the stem to transmit rotational movement to the stem in one direction only, the method including the step of rotating the valve member relative to the valve housing only during axial movement of the valve member in at least one direction of axial movement by said ratchet means so as to vary the relative contact position of the respective seat and sealing surfaces.

* * * * *